US012385205B2

(12) United States Patent
Gempler

(10) Patent No.: US 12,385,205 B2
(45) Date of Patent: Aug. 12, 2025

(54) SEGMENTAL METHOD FOR INSTALLING WICK DRAINS

(71) Applicant: Keller North America, Inc., Hanover, MD (US)

(72) Inventor: Ronald Alan Gempler, Colorado Springs, CO (US)

( * ) Notice: Subject to any disclaimer, the term of this patent is extended or adjusted under 35 U.S.C. 154(b) by 104 days.

(21) Appl. No.: 18/132,057

(22) Filed: Apr. 7, 2023

(65) Prior Publication Data

US 2023/0392335 A1 Dec. 7, 2023

Related U.S. Application Data

(60) Provisional application No. 63/329,023, filed on Apr. 8, 2022.

(51) Int. Cl.
*E02D 3/10* (2006.01)
*E02B 11/02* (2006.01)

(52) U.S. Cl.
CPC ..... *E02D 3/103* (2013.01); *E02B 11/02* (2013.01)

(58) Field of Classification Search
CPC ..... E02D 3/103; E02B 11/02
See application file for complete search history.

(56) References Cited

U.S. PATENT DOCUMENTS 1,403,766 A * 1/1922 Gillies ..... E02D 5/665 405/246
2,577,252 A * 12/1951 Kjellman ..... E21B 19/084 405/45
2,729,067 A * 1/1956 Patterson ..... E02D 5/62 175/388
3,016,117 A * 1/1962 Petersen ..... E02D 5/801 52/165

(Continued)

FOREIGN PATENT DOCUMENTS

| | | |
|---|---|---|
| AU | 2019203148 | 11/2019 |
| KR | 20050115835 | 12/2005 |
| WO | WO2021071924 | 4/2021 |

OTHER PUBLICATIONS

CURT 45791 8-Inch Long Trailer Hitch Extension for 2-Inch Receiver.

*Primary Examiner* — Edwin J Toledo-Duran
(74) *Attorney, Agent, or Firm* — Steven Scott Lloyd

(57) ABSTRACT

The invention described herein includes materials and methods for segmental wick drain installation for versatile groundwater management. The invention comprises modified mandrels that may be coupled together for segmental installation wick drain installations to desired depths that are not achievable using currently known methods. Each modified mandrel is configured with a shoe coupler that may be permanently affixed to one end and configured with a means for securing the shoe coupler to a modified end of another mandrel. Each shoe coupler includes transverse bore holes (Continued)

through which set pins may be inserted that engage with an end of another modified mandrel with grooves corresponding to the locations of the bore holes when set pins are inserted. Once the wick drain is installed to the desired depth, the mandrels may be extracted and uncoupled by removing the set pins. The modified mandrels may be prefabricated and reused, ideal for multiple installations.

6 Claims, 6 Drawing Sheets

(56) References Cited

U.S. PATENT DOCUMENTS 3,107,497 A * 10/1963 Hoppe ..... E02D 7/30 403/204
3,187,825 A * 6/1965 Bower, Jr. ..... E21B 10/44 175/323
3,220,195 A * 11/1965 Barcus ..... E02D 7/30 242/573.7
3,243,962 A * 4/1966 Ratliff ..... E02D 3/12 405/269
3,585,803 A * 6/1971 Bardgette ..... E02D 5/523 285/308
3,881,319 A * 5/1975 Katagiri ..... E02B 11/00 405/50
4,009,582 A * 3/1977 LeCorgne ..... E02D 5/385 405/240
4,031,969 A * 6/1977 Cullen ..... E21B 17/003 166/66.4
4,102,141 A * 7/1978 Ingalls ..... E02D 5/48 405/250
4,166,508 A * 9/1979 Van Den Berg ..... E02D 3/103 175/320
4,436,452 A * 3/1984 Bodine ..... E02D 7/18 299/14
4,467,575 A * 8/1984 Dziedzic ..... E02D 5/801 52/157
4,668,119 A * 5/1987 Galletti ..... E02D 5/523 405/251
5,054,961 A * 10/1991 Sherman ..... B09C 1/08 405/129.7
5,149,149 A * 9/1992 Wu ..... F16B 7/0413 403/348
5,213,449 A * 5/1993 Morris ..... E21B 19/083 175/162
5,439,326 A * 8/1995 Goughnour ..... E02D 3/10 405/303
5,575,593 A * 11/1996 Raaf ..... E02D 5/801 405/232
5,658,091 A * 8/1997 Goughnour ..... E02D 3/10 405/303
5,758,993 A * 6/1998 Schmednecht ..... E02D 19/18 405/274
5,833,399 A * 11/1998 Bullivant ..... E21B 17/046 405/292
5,842,521 A * 12/1998 Tetzlaff ..... E21B 34/08 166/325
5,919,005 A * 7/1999 Rupiper ..... E02D 3/10 175/323
5,934,836 A * 8/1999 Rupiper ..... E02D 3/12 52/157
6,039,508 A * 3/2000 White ..... E02D 11/00 254/95
6,142,711 A * 11/2000 Goughnour ..... E02D 7/18 74/61
6,179,527 B1 * 1/2001 Goughnour ..... E02D 3/10 74/89.1
6,183,167 B1 * 2/2001 Ruiz ..... F16B 7/042 405/253
6,431,795 B2 * 8/2002 White ..... E02D 11/00 254/95
6,447,036 B1 * 9/2002 White ..... B66C 1/427 294/201
6,615,554 B2 * 9/2003 Rupiper ..... E02D 5/801 52/165
7,080,958 B1 * 7/2006 Morris ..... E02D 9/02 173/210
7,314,335 B2 * 1/2008 Whitsett ..... E02D 5/38 405/253
7,338,232 B2 * 3/2008 Nasr ..... E02D 5/56 405/252.1
8,328,470 B2 * 12/2012 Maher ..... E02D 3/046 405/232
8,888,413 B2 * 11/2014 Seider ..... E02D 5/56 405/250
9,249,551 B1 * 2/2016 White ..... E02D 11/00
10,024,019 B1 * 7/2018 Hunter ..... E02D 5/56
10,472,789 B2 * 11/2019 Stork ..... E02D 3/103
10,563,370 B2 * 2/2020 Savinkoff ..... E02D 7/18
2001/0002230 A1 * 5/2001 White ..... E02D 11/00 405/232
2002/0098044 A1 * 7/2002 White ..... E02D 11/00 405/232
2004/0115007 A1 * 6/2004 DeWitt ..... E02D 5/38 405/257
2004/0146357 A1 * 7/2004 Goughnour ..... E02D 3/10 405/50
2005/0141964 A1 * 6/2005 Tomlinson ..... E02D 9/04 405/50
2006/0088388 A1 * 4/2006 Wissmann ..... E02D 3/08 405/249
2011/0280670 A1 * 11/2011 Irvine ..... E02D 5/04 405/274
2012/0114425 A1 * 5/2012 Seider ..... F16B 7/182 405/252.1
2013/0279984 A1 * 10/2013 Tomlinson ..... E02D 3/103 405/50
2014/0003868 A1 * 1/2014 DeWitt ..... E02D 5/66 405/232
2016/0010675 A1 * 1/2016 Chu ..... F16B 7/182 403/296
2017/0159256 A1 * 6/2017 Li ..... E02D 5/24
2019/0177943 A1 * 6/2019 Stork ..... E02D 3/103
2022/0025602 A1 * 1/2022 Legault ..... E02D 11/00
2022/0056656 A1 * 2/2022 Legault ..... E02D 3/103
2024/0060387 A1 * 2/2024 Malave ..... E21B 33/1265

* cited by examiner

SEGMENTAL METHOD FOR INSTALLING WICK DRAINS

CROSS-REFERENCE TO RELATED APPLICATIONS

This application claims the benefit of priority of U.S. Provisional App. Ser. No. 63/329,023, filed Apr. 8, 2022, the contents of which are hereby incorporated herein by reference in their entirety.

BACKGROUND OF THE INVENTION

1. Field of the Invention

The present invention relates generally to geotechnical engineering and, in particular, an improved method for installing wick drains using segmental mandrel sections.

2. Description of the Background

The ground improvement and deep foundation industries rely on various types of drainage systems. For example, wick drains, also known as Prefabricated Vertical Drains (PVD) are prefabricated geotextile filter-wrapped plastic strips with molded channels. The flexible strip or "core" is typically manufactured of polypropylene and both sides have grooves allowing water to flow unimpeded. The core is wrapped in a strong and durable geotextile filter fabric with excellent filtration properties, allowing free access of pore water into the drain. This also prevents piping of fines from adjacent soils without clogging.

Wick drains are typically installed in soft, saturated fine-grain soils, such as silts, clays, peat, sludges, mine tailings and dredge fills, all permeable and normally filled with water (fully saturated). The wick drains act as drainage paths to take out pore water, accelerating drainage, and consolidating soil faster, often from decades to months.

At installation the wick drain is fed down through a hollow mandrel mounted on an excavator or crane mast and is connected at the bottom to an expendable anchor plate. A vibratory hammer or static method is used to insert the mandrel to design depth. The mandrel is the extracted leaving the anchor plate and wick drain in place. The wick drain is cut at the ground surface, and the equipment is moved to the next location. A pattern of installed vertical wick drains provides short drainage paths for pore water, which accelerates the consolidation process and the construction schedule.

FIG. 1 illustrates a conventional wick drain installation apparatus and method. The wick drain 2 is fed from a spool 4 up to the top of an excavator mast 6 and down through the mast 6 into a hollow mandrel 8, through the entire mandrel 8, and is connected at the bottom of the mandrel 8 to an expendable anchor plate 7 which is releasably inserted into mandrel 8. The typical mandrel 8 is a rectangular hollow steel tube. The mandrel 8 is carried in a drive system 5 in the mast 6 for downward insertion. The drive system 5 may be any suitable conventional drive system, including hydraulic/cable drive, hydraulic cylinder drive, bottom gear drive, sprocket drive, or the like. For example, American Pile Driving Equipment, Inc. (APE) offers it Bottom Drive™ wick drain drivers, OMS (Germany) offers sprocket drive wick drain drivers, and U.S. Pat. No. 4,755,080 to Cortlever et al. shows a chain or cable drive. As disclosed in U.S. Pat. No. 6,431,795 to White, a vibratory hammer or other assist may be used to help insert the mandrel 8 to design depth.

Once inserted the mandrel 8 is removed leaving the anchor plate 7 and wick drain 2 in place. The wick drain 2 is cut at the ground surface, and the mandrel 8 is moved to the next location where a new length of wick drain 2 is spooled and connected to a new anchor plate 7. The process is repeated and a pattern of installed vertical wick drains 2 may be installed as shown to provide short drainage paths for pore water, which accelerates the consolidation process and the construction schedule.

Unfortunately, using a conventional wick drain installation apparatus and method, one needs a fixed length mast/mandrel to install an equal-length wick drain (e.g., a 100' wick drain rig/mandrel to install a 100' wick drain). However, there is a need for variability in installation length requirements that existing wick drain installation equipment cannot accommodate. For example, if a 100' wick drain needs to be installed beneath 60' power lines existing wick drain installation equipment simply cannot be used.

What is needed is a segmental installation method that splices together as many segments of wick as needed to reach a desired depth, thereby eliminating the need for a 100' mandrel to install 100' of wick drain.

BRIEF SUMMARY OF THE INVENTION

It is, therefore, an object of the present invention to provide a segmental installation method that splices together as many segments of wick as needed to reach a desired depth, thereby eliminating the need for a fixed-length mast and mandrel to install that length of wick drain.

According to the present invention, the above-described and other objects are accomplished by providing a novel shoe coupler comprising an open-ended receptacle having an aperture at both ends of substantially uniform cross-section, both apertures configured for slidable insertion of a mandrel. The shoe coupler has a constant cross-section except for a partition offset from one end, and a pair of bore-holes offset from the other end for insertion of two set pins. A plurality of mandrel sections is modified each by attaching a shoe coupler at one end by welding or the like, and by machining two transverse grooves at the opposing end. After calculating a proper number of modified mandrels needed to reach a desired depth, an operator undertakes segmental installation by installing and driving mandrel sections and cutting and splicing wick drain sections together as needed to reach a desired depth. Once a first mandrel segment has been driven into the earth, the operator knocks out two release pins from the shoe coupler to disconnect that segment from the mast. They cut the wick drain with enough room to make a splice, attach another mandrel segment to the installer machine, feed another length of wick drain through it, splice it to the first, and couple the segments together at the shoe coupler, and repeat as necessary. The advantage is that one can install any length of wick drain with a standard 40' wick drain rig.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE INVENTION

Reference will now be made in detail to preferred embodiments of the present invention, examples of which are illustrated in the accompanying drawings. Wherever possible, the same reference numbers will be used throughout the drawings to refer to the same or like parts.

The present invention generally comprises a segmental installation method for wick drains (a.k.a., prefabricated vertical drains, or PVDs) that incrementally inserts and splices together as many segments of wick drain as needed to reach a desired depth. The method employs multiple mandrel segments coupled together by a unique shoe coupler also disclosed.

Figure 1:
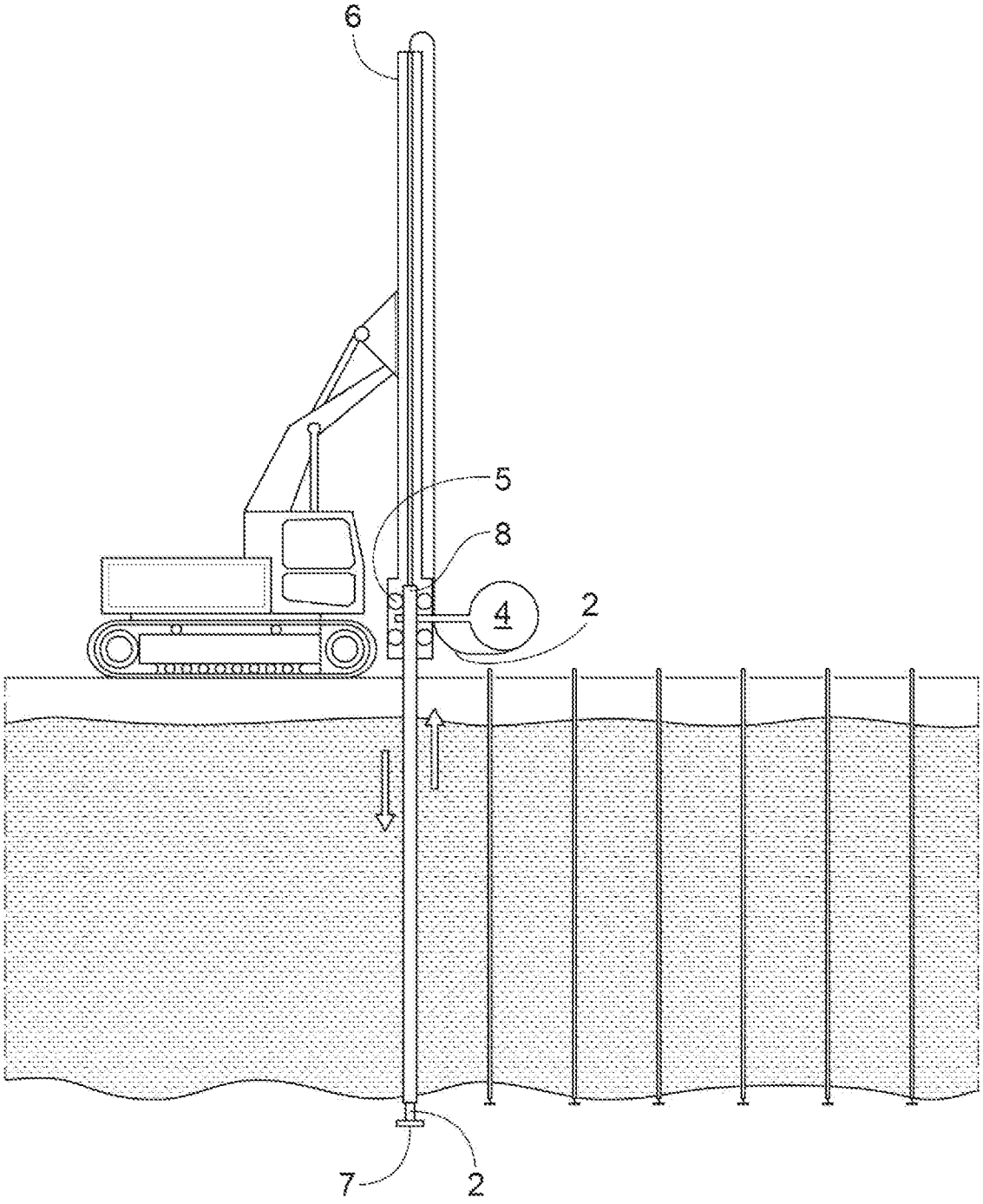
FIG. 1 (Prior Art)
FIG. 1 illustrates a conventional wick drain installation apparatus and method.
Figure 2:
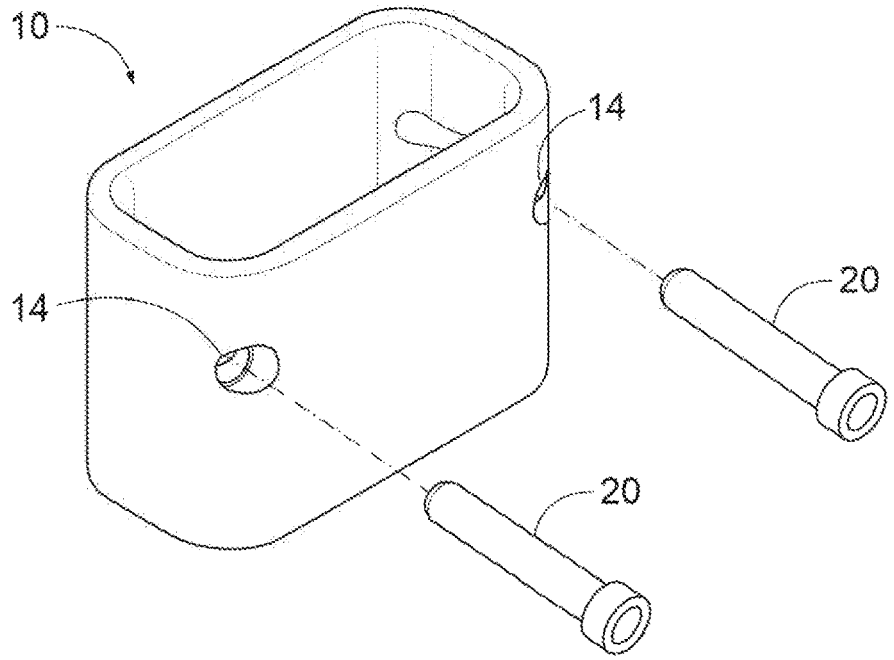
FIG. 2 is a perspective view of the shoe coupler 10.
Figure 3:
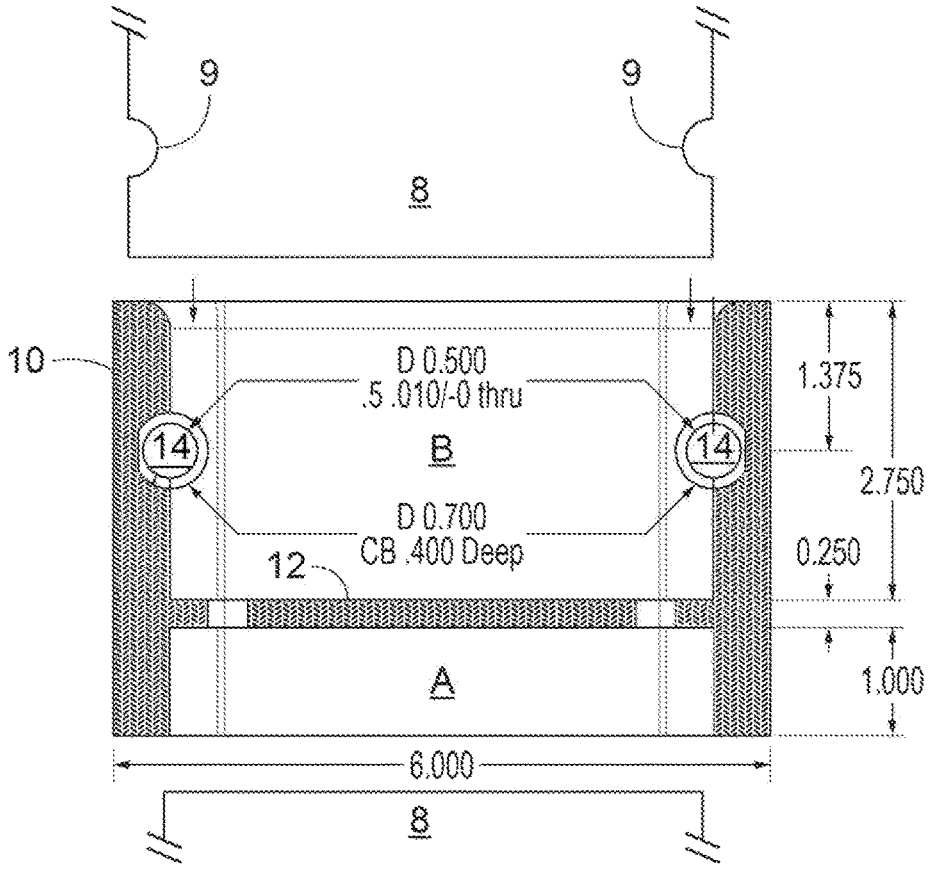
FIG. 3 is a side cross-section of the shoe coupler 10 with exemplary dimensions.

With reference to FIGS. 2-3, the shoe coupler 10 comprises an open-ended receptacle having an identical aperture at both ends configured for slidable insertion of a mandrel section 8 at both ends. One skilled in the art will understand that mandrels may take a variety of shapes but are typically rectangular, and so a rectangular shoe coupler 10 embodiment is disclosed. The shoe coupler 10 has a constant cross-section along its entire length except for a partition 12 (FIG. 3) offset from one end by approximately one third lengthwise, and a pair of countersunk bore holes 14 offset from the other end by approximately one third. The full or partial partition 12 subdivides the interior into two sections A and B. Section A of the shoe coupler 10 is intended to be permanently affixed by welding or the like onto one end of a first mandrel 8 section. The other end section B of the shoe coupler 10 is intended to be removably affixed as will be described onto one end of a second mandrel 8 section. Each mandrel section 8 to which shoe coupler 8 is installed should be modified at the other end by machining two transverse grooves 9 (FIG. 3) on opposing sides, the grooves 9 corresponding in position to bore holes 14.

The bore holes 14 fully traverse the interior section B of shoe coupler 10 midway and are configured for insertion of retaining pins 20. When inserted the retaining pins 20 partially interrupt the interior channel of shoe coupler 10 and engage the transverse grooves 14 on opposing sides of mandrel section 8 inserted therein to secure it.

FIG. 3 also provides a set of exemplary dimensions in inches, although dimensions may be scaled as needed or altered for different mandrel shapes (diamond, square, etc.).

After calculating a proper number of modified mandrels 8 needed to reach a desired depth, conventional mandrels 8 are modified each by inserting and welding Section A of a shoe coupler 10 onto one end of a first mandrel 8 section (one shoe coupler 10 per mandrel 8, see FIG. 3), and by machining the other end of each mandrel 8 with two transverse grooves 9 on opposing sides. Thus, in practice, several modified mandrels 8 will be provided at a job site, each with a shoe coupler 10 pre-welded on one end (and pins 20 pre-inserted), and machined at the other with the two transverse grooves 14 on opposing sides.

The segmental installation method for wick drains proceeds as follows.

Figure 4:
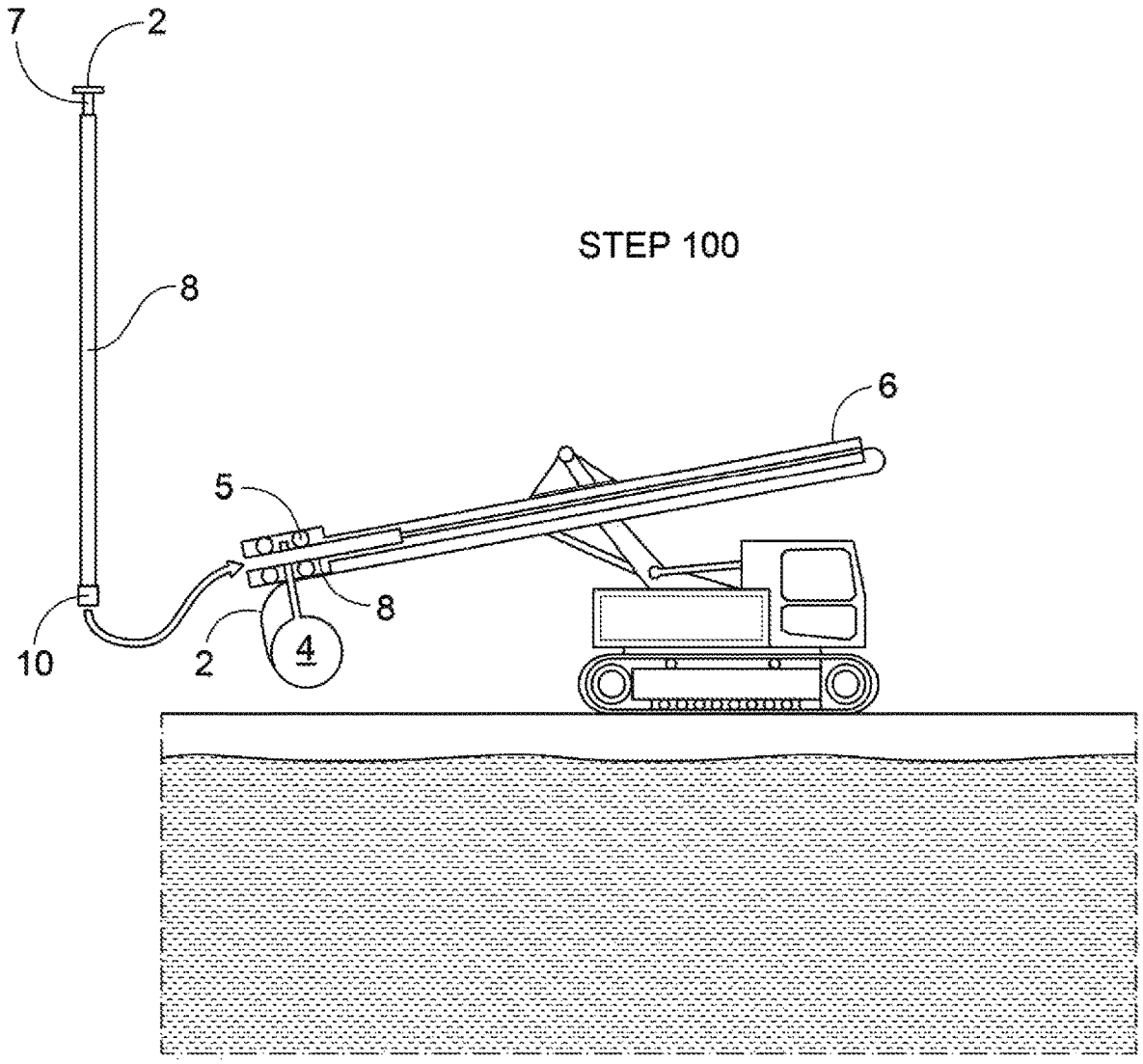
FIG. 4 illustrates the step of loading a modified mandrel into the drive system and mast, and loading a length of wick drain through this section of mandrel.

At step 100 (FIG. 4), the operator lays the mast 6 down and inserts a modified mandrel into the drive system 5 and mast 6, loading the wick drain 2 through this section of mandrel 8. The wick drain 2 is fed from a spool 4 up to the top of the excavator/crane mast 6 and down through the hollow mandrel 8. An anchor plate 7 is installed into the end of mandrel 8 and the wick drain is attached to the anchor 7 in a known manner.

Figure 5:
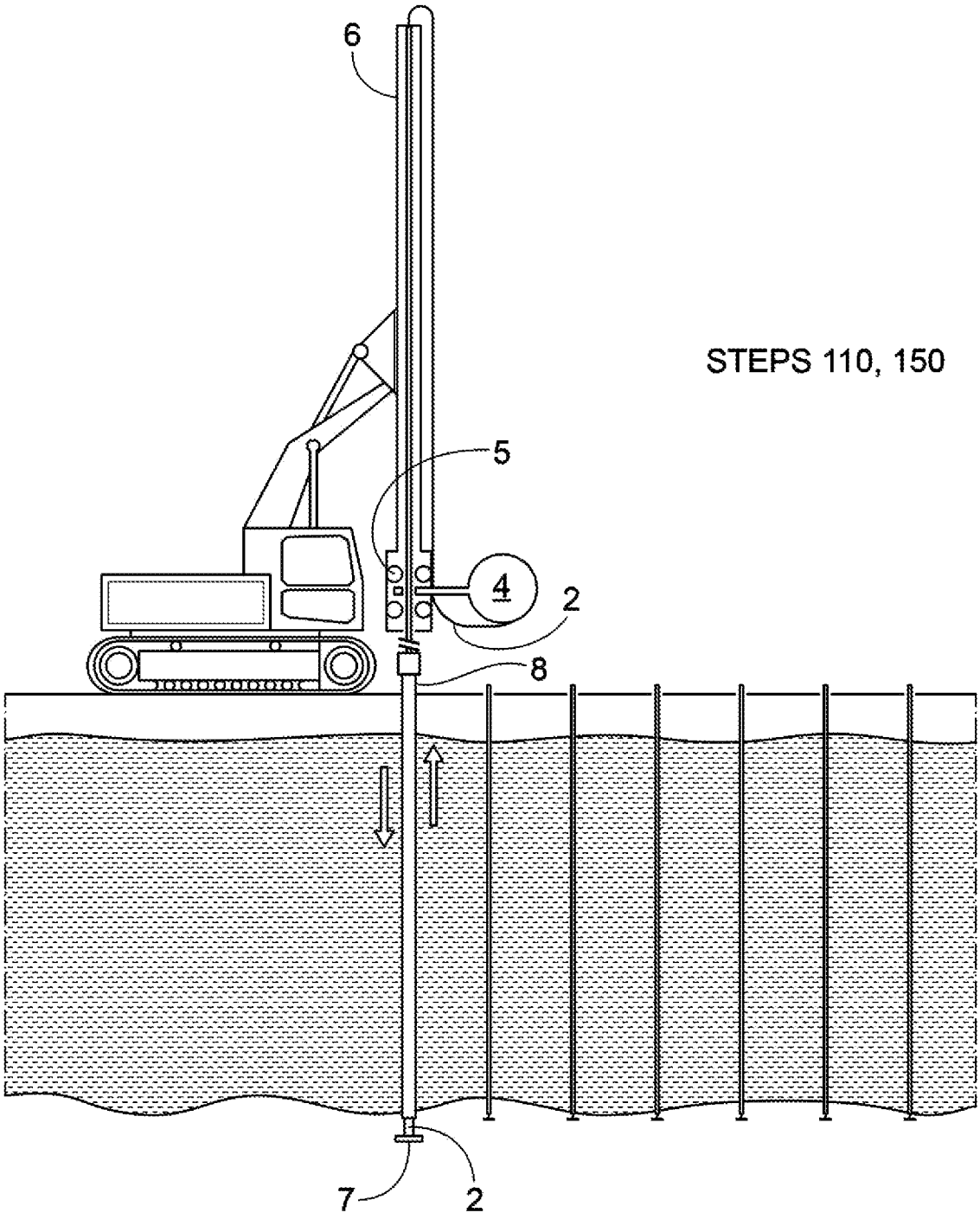
FIG. 5 illustrates the step of driving the first mandrel section to depth and out of the drive system and cutting the wick drain make a splice.

At step 110 (FIG. 5), the operator drives the mandrel 8 to depth using optional vibratory hammer, overdriving the shoe coupler 10 beyond the drive system 5 leaving the mandrel 8, anchor plate 7 and wick drain 2 all in place. The wick drain 2 is cut where indicated leaving enough room to make a splice.

Figure 6:
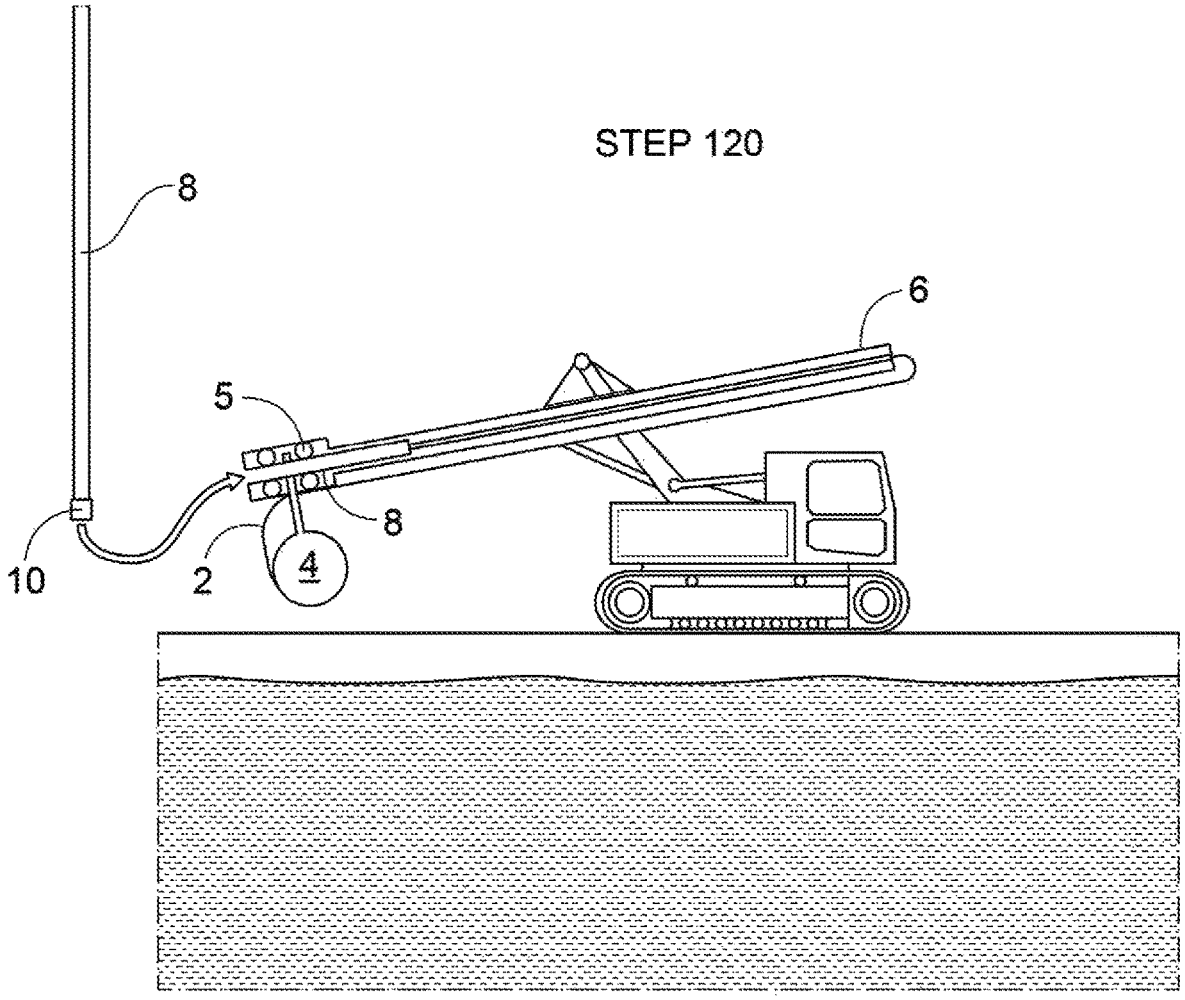
FIG. 6 illustrates the step of laying the mast down and loading a second modified mandrel into the drive system.

At step 120 (FIG. 6), the operator lays the mast 6 down and inserts another modified mandrel 8 into the drive system 5 and mast 6, loading the wick drain 2 entirely through this second section of mandrel 8 and out the end.

Figure 7:
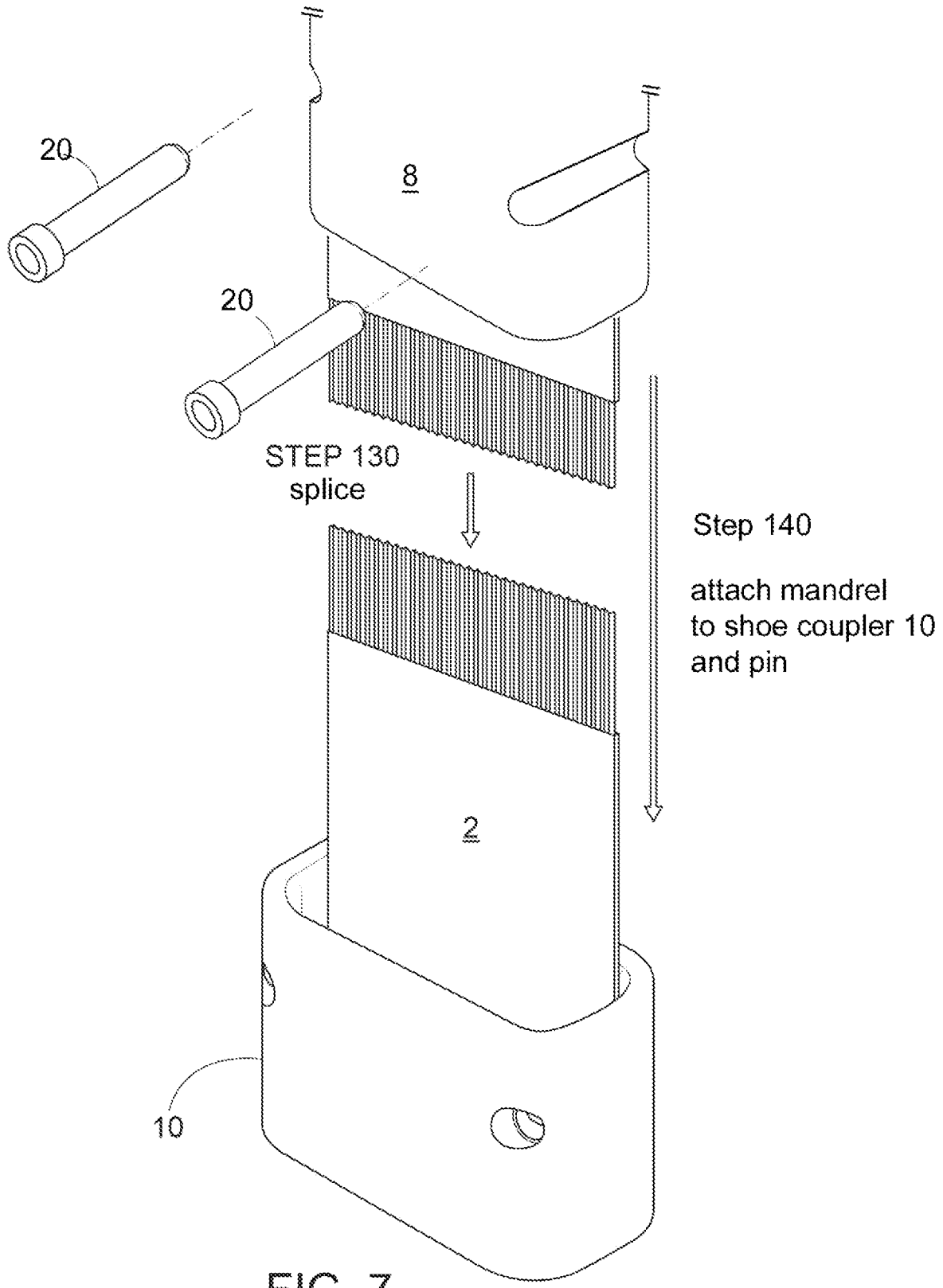
FIG. 7 illustrates splicing the free ends of the wick drain together and stapling

At step 130 (FIG. 7), the free end of the wick drain 2 is spliced to the cut end protruding from the ground. This is best accomplished by telescoping the two ends together and stapling.

At step 140 (FIG. 7) the second section of mandrel 8 protruding from the drive system 5 is inserted into the open upper end of shoe coupler 10 (see FIG. 7) and is affixed therein by insertion of pins 20.

At step 150 (FIG. 5) the operator again drives the second section of mandrel 8 to depth, and out of the drive system 5 again leaving the mandrel 8, anchor plate 7 and wick drain 2 all in place. The wick drain 2 is cut where indicated leaving enough room to make a splice The operator repeats steps 100-150 as many times as needed to reach design depth, leaving the anchor plate 7 and wick drain 2 in place.

Finally, the mandrel sections 8 are removed one by one. Each section of mandrel 8 is extracted until the shoe coupler 10 is exposed above ground. The operator knocks out the two pins 14 to uncouple the shoe coupler 10 from the mandrel 8 section in the mast, ejects the mandrel 8 section from the mast, and repeats until all sections are removed.

In practice, it is even more efficient to work two PVD installation sites together, extracting each section of mandrel 8 from the first site, uncoupling and immediately inserting the extracted section into the next PVD site after putting a new anchor 7 on.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A method for segmental wick drain installation comprising the steps of:

obtaining a plurality of mandrels;

then loading a first mandrel into a drive system;

then feeding a wick drain through the first mandrel;

then installing an anchor plate on the first end of the mandrel;

then attaching the wick drain to the anchor plate;

then driving the first end of the first mandrel into the ground, leaving a second end of the first mandrel above ground;

then cutting the wick drain above the second end of the first mandrel to define a first wick drain segment;

then loading a second mandrel into the drive system;

then feeding the wick drain through the second mandrel until the free end protrudes through the first end of the second mandrel;

then splicing the free end of the wick drain to the cut end of the first wick drain segment;

then removably coupling the first end of the second mandrel to the second end of the first mandrel by inserting the first end of the second mandrel into a shoe coupler attached to the second end of the first mandrel and then inserting at least one set pin through the shoe coupler to affix the first end of the second mandrel therein; and then driving the second mandrel into the ground.

2. The method of claim 1, wherein said step of removably coupling the first end of the second mandrel to the second end of the first mandrel comprises inserting a pair of set pins through the shoe coupler to affix the first end of the second mandrel therein.

3. The method of claim 1, further comprising the steps of:

defining a desired underground depth for said segmental wick drain installation; and repeating the steps of claim 1 as many times as needed to install the wick drain to the desired underground depth.

4. The method of claim 1, wherein the step of splicing the free end of the wick drain to the cut end of the first wick drain segment is achieved by stapling.

5. The method of claim 1, further comprising a step of removing the first and second mandrel from the ground leaving the wick drain segment attached to the shoe coupler at said desired depth.

6. The method of claim 1, further comprising a step of removing the pair of set pins to uncouple the second mandrel from the first mandrel.

* * * * *